US006474617B1

(12) United States Patent
Sahertian

(10) Patent No.: US 6,474,617 B1
(45) Date of Patent: Nov. 5, 2002

(54) APPARATUS TO SUPPORT A LIGHT POST AND SUCH A LAMP POST

(75) Inventor: Roy Richard Sahertian, Wormer (NL)

(73) Assignee: Rocad Engineering, Koog aan de Zaan ( * ) Notice: Subject to any disclaimer, the term of this patent is extended or adjusted under 35 U.S.C. 154(b) by 0 days.

(21) Appl. No.: 09/690,906

(22) Filed: Oct. 17, 2000

(51) Int. Cl.[7] ..... F16M 13/00; B66C 23/06
(52) U.S. Cl. ..... 248/519; 52/121
(58) Field of Search ..... 248/519, 528, 248/529, 188.6, 910, 346.01, 346.04, 346.2, 346.3, 440, 170, 439; 52/121, 116

(56) References Cited

U.S. PATENT DOCUMENTS

| | | | | | |
|---|---|---|---|---|---|
| 2,410,227 | A | * | 10/1946 | Matthews | 47/40.5 |
| 3,302,345 | A | * | 2/1967 | Ballantine | 52/121 |
| 3,605,359 | A | * | 9/1971 | Bader et al. | 52/146 |
| 3,805,463 | A | * | 4/1974 | Lang et al. | 52/116 |
| 3,953,029 | A | * | 4/1976 | Boyd | 473/575 |
| 4,185,288 | A | * | 1/1980 | Dosch et al. | 343/765 |
| 4,309,836 | A | * | 1/1982 | Knapp | 40/602 |
| 4,920,710 | A | * | 5/1990 | Paine | 52/108 |
| 5,233,809 | A | * | 8/1993 | Gropper | 52/150 |
| 5,422,638 | A | * | 6/1995 | Singer et al. | 240/908.1 |
| 5,794,387 | A | * | 8/1998 | Crookham | 52/122.1 |

FOREIGN PATENT DOCUMENTS

| | | |
|---|---|---|
| EP | 0379335 | 7/1990 |
| FR | 1531886 | 11/1968 |
| FR | 2741739 | 5/1997 |
| GB | 2319385 | 5/1998 |

* cited by examiner

*Primary Examiner*—Anita King
(74) *Attorney, Agent, or Firm*—Jeffrey D. Myers

(57) ABSTRACT

An apparatus for supporting a lamp post or the like, comprising a base frame, and at least a first support column coupled with an end to the base frame and having at its other end a first coupling member for fastening to the light post, at a position removed from the base frame, wherein a second support column is provided whose one end is coupled with the base frame and whose other end is provided with a second coupling member for fastening to the first support column, between its to extremities, such that the first coupling member of the first support column that is to be coupled to the light post, is above the base frame and, viewed from the top, between the ends of the first and a second support columns coupled to the base frame.

6 Claims, 2 Drawing Sheets

APPARATUS TO SUPPORT A LIGHT POST AND SUCH A LAMP POST

Figure 1:
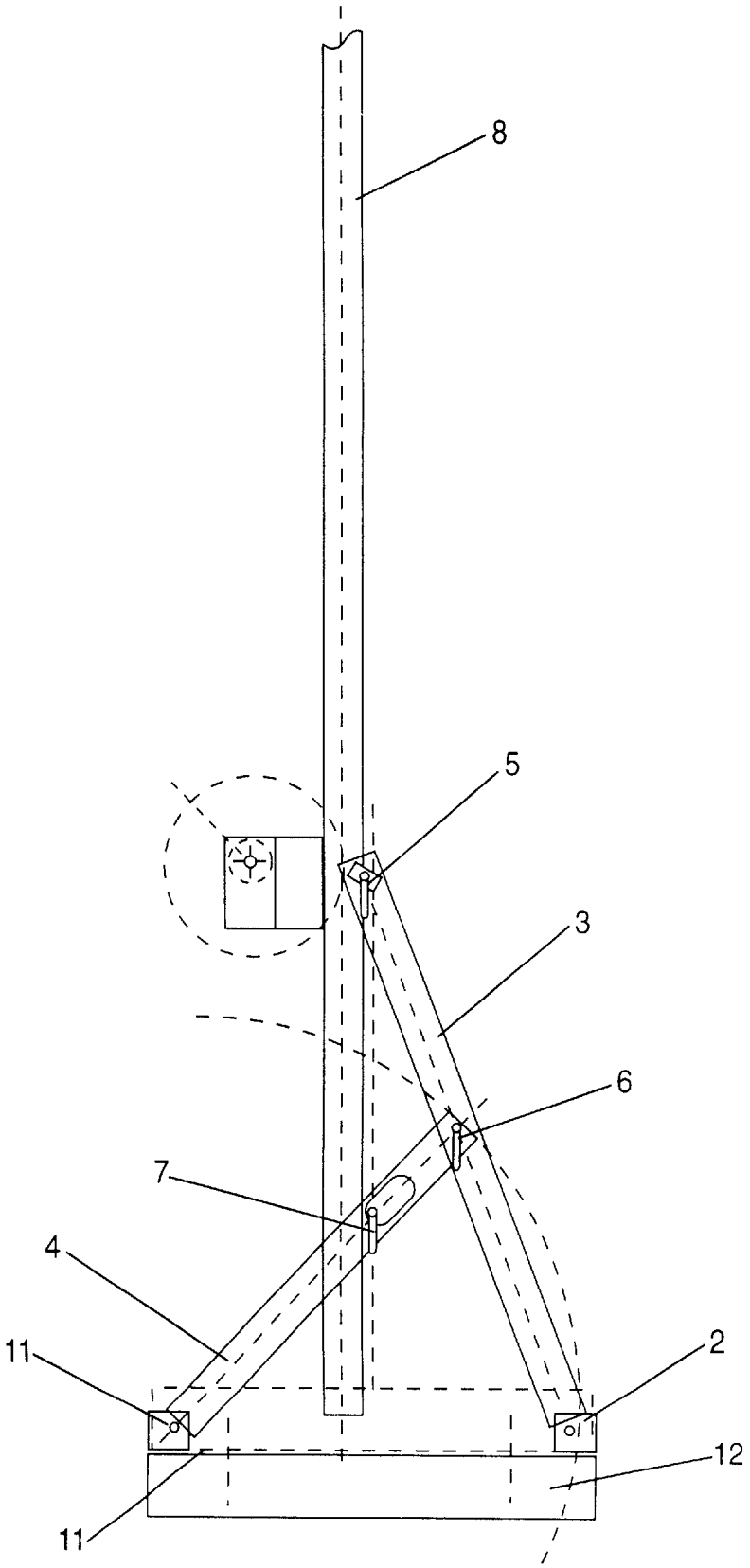

The invention relates to an apparatus for supporting a lamp post or the like, comprising a base frame, and at least a first support column coupled with an end to the base frame and having at its other end a first coupling member for fastening to the light post, at a position removed from the base frame.

The invention also relates to a light post that can be used with such an apparatus.

The European patent application EP-A-0 379 335 discloses a mobile telescoping post provided with a post support coupled at one end with a mobile base frame while at the other end being coupled to the post, at a position removed from the base frame. Especially in the construction industry there is a need for an easily erectable and mobile facility for light posts which requires little space after it has been used and dismantled. The known apparatus cannot be used for this purpose because although it is mobile, in respect of standing and storage space it is very uneconomical.

The object of the invention is to solve this problem and to achieve further advantages, which will be explained in the following.

The apparatus according to the invention is characterized in that it is provided with a second support column whose one end is coupled with the base frame and whose other end is provided with a second coupling member for fastening to the first support column, between its to extremities, such that the first coupling member of the first support column that is to be coupled to the light post, is above the base frame and, viewed from the top, between the ends of the first and a second support columns coupled to the base frame. Conveniently, the second support column is provided with a third coupling member for fastening to the light post such that when the base frame is in a horizontal position, the light post, if it is at the same time attached to the first coupling member of the first support column, will be in a substantially vertical position. The first, second and third coupling members are preferably designed as facilities providing a detachable fastening.

The apparatus according to the invention has the advantage that the light post can be erected so as to be very stable due to the stabilizing triangles created as a result of how the various fastening points are positioned. The detachable fastening of the various coupling members provides the additional advantage that the light post and the apparatus supporting said light post can be completely dismantled, so that the dimensions of the dismantled apparatus for the support of the light post can be very compact.

This is achieved in particular with the embodiment of the apparatus according to the invention that is characterized in that the ends of the first and second support columns coupled with the base frame are pivotingly attached to the base frame. When the light post is dismantled, the first and second support columns can be pivoted such that they fold flat onto the base frame, which means not only that the apparatus takes up little space but also that it can be stacked with similar apparatuses for supporting a light post.

Figure 2:
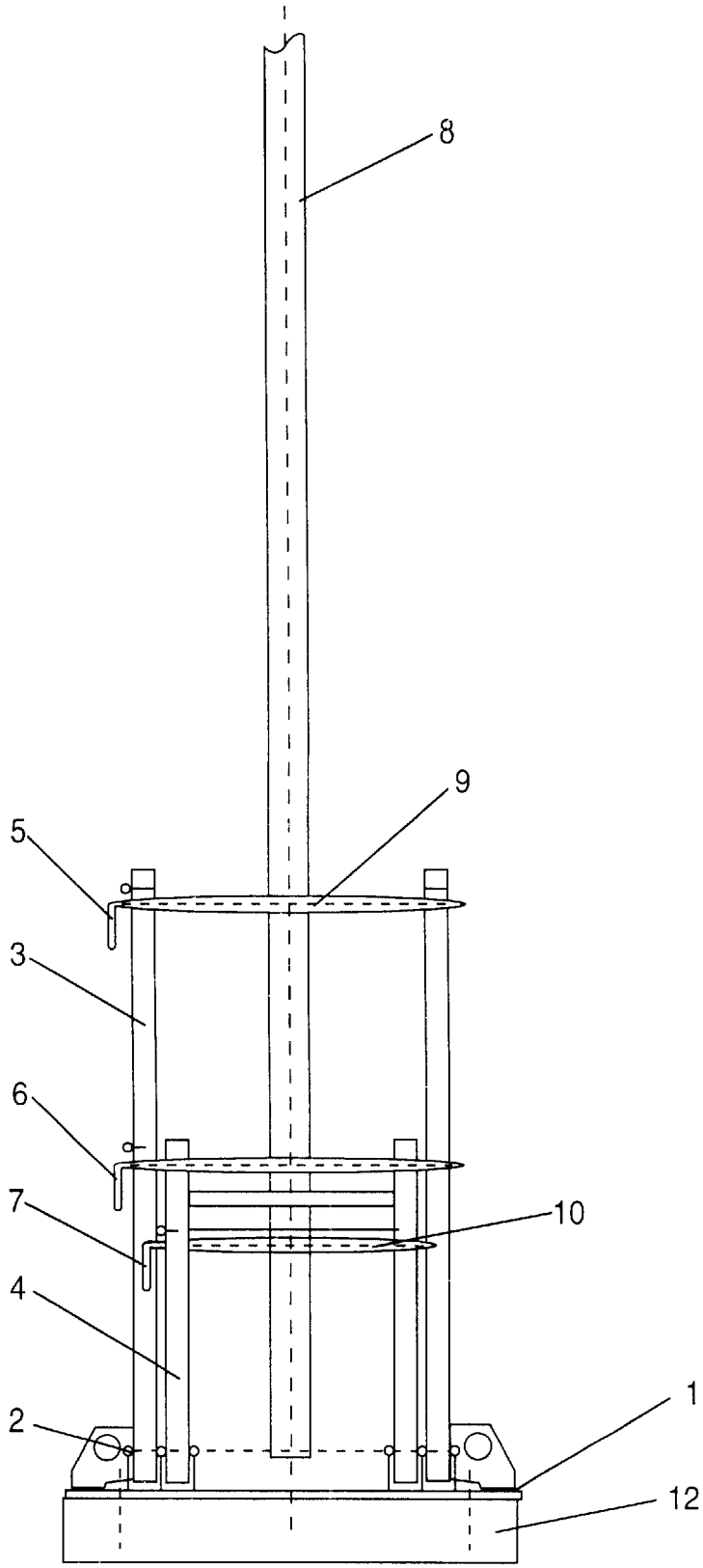

A simple design of the coupling member is one in which the first or second support column, respectively, is each provided with an opening suitable for receiving a pin. According to the invention, the light post to be erected will then be characterized in that the light post is provided with box profiles suitable for receiving said pin. The invention will now be elucidated with reference to the drawings in which FIGS. 1 and 2 show the apparatus and light post according to the invention in a side and front view, respectively. The FIGS. 1 and 2 show the apparatus for supporting the light post, and the light post in mounted condition.

The apparatus for supporting the light post comprises a base frame 1 and a first support column 3 which at one end 2 is coupled with the base frame 1 and that at the other end is provided with a first coupling member 5 for fastening to the light post 8 at a position removed from the base frame 1, as shown in the Figures. The apparatus for supporting the light post 8 is further provided with a second support column 4 whose one end 11 is coupled with the base frame 1 and whose other end is provided with a second coupling member 6 for fastening to the first support column 3 between its two ends, such that the first coupling member 5 of the first support column 3 to be coupled to the light post 8, is positioned above the base frame 1 and, viewed from above, between the ends 2, 11 of the first and second support columns 3, 4 coupled to the base frame 1. When the base frame 1 is positioned horizontally, this allows the light post 8 to be erected substantially vertically, as shown in the Figures. To this end, the second support column 4 is provided with a third coupling member 7 for fastening to the light post 8, to ensure the vertical positioning of the light post 8.

The first, second, and third coupling members 5, 6, and 7 provide detachable fastenings that allow the light post 8 to be removed from its supporting apparatus. In addition, being able to remove the second coupling member 6, makes it possible to collapse the first support column 3 and the second support column 4 so as to be folded flat onto the base frame 1. This is further aided by the fact that the ends 2, 11 of the first and second support columns 3, 4 coupled with the base frame 1, are pivotingly attached to the base frame 1.

Preferably, the base frame 1 is mounted on a base plate 12 acting as counter weight and conferring stability on the assembly.

As is clearly shown in FIG. 2, the first, second, and third coupling members 5, 6, 7 are embodied as openings provided in the first and second support columns 3, 4, respectively, each of which is suitable to receive a pin to effectuate the fastening.

Furthermore, at the level of the first coupling member 5 and the third coupling member 7, the light post 8 is provided with box profiles 9 and 10. Said box profiles 9 and 10 are also suitable for receiving the pins mentioned earlier.

To the person skilled in the art it will be obvious that within the scope of the invention numerous variations on the above-described embodiment are possible. This exemplary embodiment is therefore to be understood as being non-limiting and as merely serving to elucidate the invention, the scope of protection being determined solely by the appended claims.

What is claimed is:

1. An apparatus for supporting a light post, comprising a base frame, and at least a first support column coupled with an end to the base frame and having at the first support column's other end a first coupling member for fastening to the light post, at a position removed from the base frame, and additionally comprising a second support column whose one end is coupled with the base frame and whose other end is provided with a second coupling member for fastening to the first support column, between the first support column's two extremities, such that the first coupling member of the first support column that is to be coupled to the light post is above the base frame and, viewed from the top, between the ends of the first and the second support columns coupled to the base frame.

2. An apparatus according to claim 1, wherein the second support column is provided with a third coupling member for fastening to the light post such that when the base frame is in a horizontal position, the light post, if the light post is at the same time attached to the first coupling member of the first column, will be substantially vertical.

3. An apparatus according to claim 2, wherein the first, second and third coupling members provide detachable fastenings.

4. An apparatus according to claim 1, wherein the ends of the first and second support columns coupled with the base frame are pivotably attached to the base frame.

5. An apparatus according to claim 1, wherein at least one of the coupling members is embodied in an opening provided in the first or second support column, respectively, and which is suitable for receiving a pin.

6. A light post suitable for use with an apparatus according to claim 1, wherein the light post is provided with box profiles suitable for receiving a securing pin.

* * * * *